US006599104B2

(12) United States Patent
Saito et al.

(10) Patent No.: US 6,599,104 B2
(45) Date of Patent: Jul. 29, 2003

(54) MOTOR-DRIVEN COMPRESSORS

(75) Inventors: Satoru Saito, Isesaki (JP); Shinichi Ohtake, Isesaki (JP)

(73) Assignee: Sanden Corporation, Gunma (JP)

( * ) Notice: Subject to any disclaimer, the term of this patent is extended or adjusted under 35 U.S.C. 154(b) by 148 days.

(21) Appl. No.: 09/961,343

(22) Filed: Sep. 25, 2001

(65) Prior Publication Data

US 2002/0039532 A1 Apr. 4, 2002

(30) Foreign Application Priority Data

Sep. 29, 2000 (JP) ..... P2000-301370
Mar. 28, 2001 (JP) ..... P2001-091887

(51) Int. Cl.[7] ..... F04B 39/05
(52) U.S. Cl. ..... 417/366; 62/508
(58) Field of Search ..... 417/366, 298, 417/310, 44.11, 63, 12; 62/505, 298, 508

(56) References Cited

U.S. PATENT DOCUMENTS 3,637,005 A * 1/1972 Nussbaum ..... 62/174
3,913,346 A 10/1975 Moody, Jr. et al.
4,319,171 A 3/1982 Motoori
4,633,151 A 12/1986 Crook
4,808,078 A 2/1989 Havens et al.
4,903,497 A 2/1990 Zimmern et al.
4,906,884 A 3/1990 Teshigawara
4,936,112 A 6/1990 Miller
5,006,045 A 4/1991 Shimoda et al.
5,103,652 A 4/1992 Mizuno et al.
5,228,309 A * 7/1993 McCullough ..... 62/323.1
5,329,788 A 7/1994 Caillat et al.
5,350,039 A 9/1994 Voss et al.
5,436,547 A 7/1995 Nagai et al.
5,640,073 A 6/1997 Ikeda et al.
5,782,610 A 7/1998 Ikeda
5,818,131 A * 10/1998 Zhang ..... 310/15
5,857,348 A 1/1999 Conry
6,086,335 A 7/2000 Bass et al.
6,112,535 A 9/2000 Hollenbeck
6,158,991 A * 12/2000 Ohtake et al. ..... 418/55.3
6,202,428 B1 3/2001 Katayama et al.
6,273,692 B1 * 8/2001 Kitano et al. ..... 418/55.3
6,321,563 B1 11/2001 Ikeda et al.

* cited by examiner

*Primary Examiner*—Teresa Walberg
*Assistant Examiner*—Vinod D. Patel
(74) *Attorney, Agent, or Firm*—Baker Botts L.L.P.

(57) ABSTRACT

A motor-driven compressor is formed integrally with a compressor device for compressing refrigerant and a motor for driving the compressor device. The motor-driven compressor includes a drive circuit and a plurality of cooling fins. The drive circuit controls the operation of the motor. The drive circuit is provided on an outer surface of a wall of a refrigerant suction route. The plurality of cooling fins are formed on an inner surface of the wall of the refrigerant suction route. In such motor-driven compressors, the drive circuit may be sufficiently cooled without using cooling devices. As a result, providing cooling devices with the drive circuit in motor-driven compressors is no longer necessary.

5 Claims, 9 Drawing Sheets

MOTOR-DRIVEN COMPRESSORS

BACKGROUND OF THE INVENTION

1. Field of the Invention

The present invention relates to motor-driven compressors formed integrally with a compressor device for compressing refrigerant and a motor for driving the compressor device, and more particularly, to motor-driven compressors that are suitable for use in air conditioning systems for vehicles.

2. Description of Related Art

Motor-driven compressors are driven by a power supply, for example, an external power source, such as a battery. Motor-driven compressors formed integrally with a compressor device for compressing refrigerant and a motor for driving the compressor device are known in the art. In known motor-driven compressors, a drive circuit for controlling the operation of the motor is separated from the compressor device and the motor, and an inverter may be coupled to the motor for converting power supplied from a power source into a suitable current for the motor. Such an inverter generally includes a plurality of switching elements. Such switching elements may generate a large amount of heat caused by, for example, electrical loss in the switching elements. Therefore, inverters equipped with cooling devices, such as an air-cooled or a water-cooled type inverter, have been used in known motor-driven compressors. In air-cooled type inverters, a radiator or a fan may be utilized. In water-cooled type inverters, a water cooling radiator and water circulating pipes may be utilized. Such additional equipment increases the cost of manufacturing the automotive air-conditioning system.

SUMMARY OF THE INVENTION

A need has arisen to provide motor-driven compressors with drive circuits that do not require additional cooling devices, such as radiators and fans.

In an embodiment of the invention, a motor-driven compressor is formed integrally with a compressor device for compressing refrigerant and a motor for driving the compressor device. The motor-driven compressor comprises a drive circuit and a plurality of cooling fins. The drive circuit controls the operation of the motor. The drive circuit is provided on an outer surface of a wall of a refrigerant suction passage. The plurality of cooling fins are formed on an inner surface of the wall of the refrigerant suction passage.

In another embodiment of the invention, a motor-driven compressor is formed integrally with a compressor device for compressing refrigerant and a motor for driving the compressor device. The motor-driven compressor comprises a drive circuit and a refrigerant flow path. The drive circuit controls the operation of the motor. The drive circuit is attached on an outer surface of a wall of a refrigerant suction passage. The refrigerant flow path is adjacent to an inner surface of the wall opposite the attachment between the driving circuit and the inner surface of the wall.

In still another embodiment of the invention, a motor-driven compressor is formed integrally with a compressor device for compressing refrigerant and a motor for driving the compressor device. The motor-driven compressor comprises a drive circuit and a plurality of ribs. The drive circuit controls the operation of the motor. The drive circuit is attached on an outer surface of a wall of a refrigerant suction passage. The plurality of ribs for reinforcing an annular boss, which supports one end of a drive shaft, are provided on an inner surface of the wall of an attachment portion of the drive shaft.

Objects, features, and advantages of embodiments of this invention will be apparent to persons of ordinary skill in the art from the following detailed description of the invention and the accompanying drawings.

BRIEF DESCRIPTION OF THE DRAWINGS

The present invention may be more readily understood with reference to the following drawings.

DETAILED DESCRIPTION OF PREFERRED EMBODIMENTS

Figure 1:
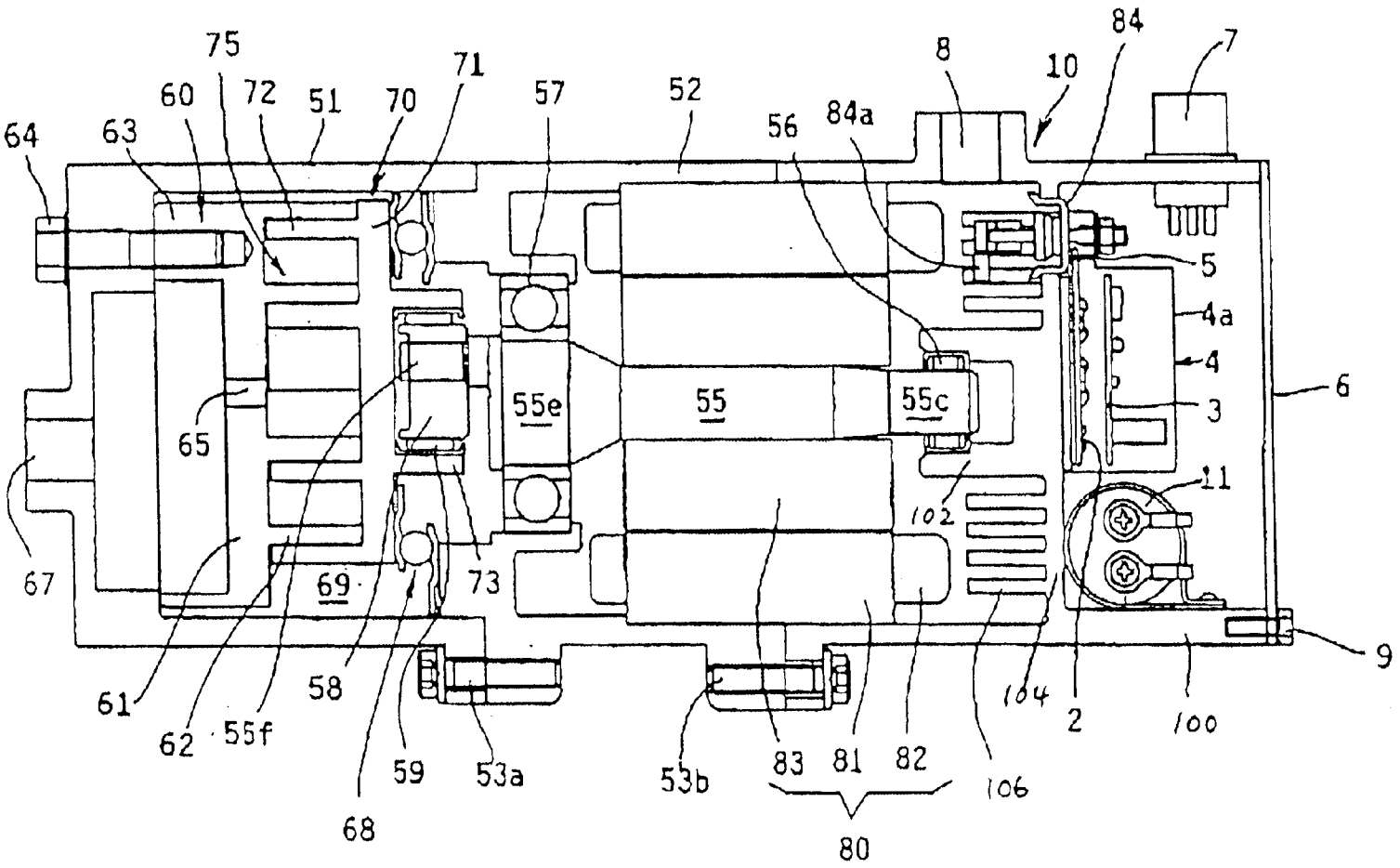
FIG. 1 is a longitudinal, cross-sectional view of a motor-driven compressor, according to a first embodiment of the present invention.

Referring to FIG. 1, a motor-driven compressor according to a first embodiment of the present invention is shown. A motor-driven compressor 10 has a discharge housing 51, an intermediate housing 52, and a suction housing 100. These housings 51, 52, and 100 may be made from a metal or a metal alloy including aluminum or an aluminum alloy. Discharge housing 51 and intermediate housing 52 are connected by a plurality of fasteners, such as bolts 53*a*. Intermediate housing 52 and suction housing 100 also are connected by a plurality of fasteners, such as bolts 53*b*. Discharge housing 51 has a discharge port 67 at its axial end portion. A fixed scroll member 60 and an orbital scroll member 70 are provided in discharge housing 51, so that members 60 and 70 together form refrigerant compression areas 75.

Fixed scroll member 60 includes an end plate 61, a spiral element 62 provided on one surface of end plate 61, and a fixing portion 63 formed on the other surface of end plate 61. Fixing portion 63 is fixed to an inner surface of the side wall of discharge housing 51 by a plurality of fasteners, such as bolts 64. A discharge hole 65 is formed through the center of end plate 61. Orbital scroll member 70 has an end plate 71, a spiral element 72 provided on one surface of end plate 70, and a cylindrical boss portion 73 projecting from the other surface of end plate 71. A rotation prevention mechanism 68 comprises a plurality of balls, each of which travels in a pair of rolling ball grooves formed in opposing ring-shaped races and is provided between the surface of end plate 71 and the axial end surface of intermediate housing 52. Rotation prevention mechanism 68 prevents the rotation of orbital scroll member 70, but allows an orbital motion of scroll member 70 at a predetermined orbital radius with respect to the center of fixed scroll member 60. A suction chamber 69 is formed outside of scroll members 60 and 70. Compression areas 75 are defined between fixed scroll member 60 and orbiting scroll member 70. Alternatively, an Oldham coupling may be used as the rotation prevention mechanism.

A drive shaft 55 is disposed in intermediate housing 52 and suction housing 100. Drive shaft 55 has a small diameter portion 55*c* at one end portion and a large diameter portion 55*e* at the other end portion. Suction housing 100 has a partition wall 104 at its axial middle portion. Partition wall 104 extends across the width of suction housing 100. A projecting boss portion 102 is provided on one side surface of partition wall 104 and extends toward the side of compression areas 75. Small diameter portion 55*c* is supported rotatably by projecting boss portion 102 via a bearing 56. Large diameter portion 55*e* is supported rotatably by intermediate housing 52 via a bearing 57. An eccentric pin 55*f* projects from an end surface of large diameter portion 55*e* in a direction along the axis of drive shaft 55. Eccentric pin 55*f* is inserted into an eccentric bush 58, which is supported rotatably by boss portion 73 of orbital scroll member 70 via a bearing 59.

A motor 80 is disposed in intermediate housing 52 and suction housing 100. Motor 80 has a stator 81, a coil 82, and a rotor 83. Stator 81 is fixed on the inner surface of intermediate housing 52 and suction housing 100. Coil 82 is provided around stator 81. Rotor 83 is fixed on drive shaft 55.

A plurality of sealed terminals 84 are provided on the upper portion, as depicted in FIG. 1, of partition wall 104 in suction housing 100. The right side and the left side of partition wall 104, as depicted in FIG. 1, are separated from each other by partition wall 104 and sealed terminals 84. A refrigerant suction port 8 is provided on the outer surface of suction housing 100 at a position on the side of intermediate housing 52 relative to the position of partition wall 104. The opening of suction housing 100, which is located at an end opposite to the side of intermediate housing 52, is closed by a lid 6. Lid 6 is fixed to the axial end of suction housing 100 via a plurality of fasteners, such as bolts 9. Lid 6 may be formed from the same material as used for suction housing 100, such as aluminum or aluminum alloy, or, alternatively, may be formed from other materials, such as iron or other magnetic materials. Preferably, lid 6 is made from a material capable of shielding electronic radiation.

A drive circuit 4 includes an inverter 2 and a control circuit 3. Drive circuit 4 and output terminals 5 of inverter 2 are provided on the right side of partition wall 104 in suction housing 100. Drive circuit 4 for controlling the operation of motor 80 is located within a case 4*a*. Output terminals 5 of inverter 2 are attached to case 4*a*. Case 4*a* is fixed on the surface of partition wall 104. Output terminals 5 are coupled to sealed terminals 84. Sealed terminals 84 are coupled to motor 80 via a plurality of lead wires 84*a*. A connector 7 is provided on the outer surface of suction housing 100 at a position on the side of lid 6 relative to the position of partition wall 104. A capacitor 11 is provided in suction housing 100 on the right side of partition wall 104. Connector 7 is connected to driving circuit 4 via capacitor 11 and is connected to an external power source (not shown), such as a battery mounted on the vehicle. A plurality of cooling fins 106 project from the left side surface of partition wall 104. Cooling fins 106 are integrally formed with partition wall 104.

In motor-driven compressor 10, when motor 80 is driven by current, such as a three-phase current provided from inverter 2, drive shaft 55 is rotated, and orbiting scroll member 70, which is supported by eccentric pin 55*c*, is driven in an orbital motion by the rotation of drive shaft 55. When orbiting scroll member 70 is driven in an orbital motion, compression areas 75, which are defined between spiral element 62 of fixed scroll member 60 and spiral element 72 of orbiting scroll member 70, move from the outer or peripheral portions of the spiral elements to the center portion of the spiral elements. Refrigerant gas, which enters into suction chamber 69 from an external fluid circuit (not shown) through suction port 8, flows into one of compression areas 75 eventually through an interior space of suction housing 100, motor 80, and an interior space within intermediate housing 52. When compression areas 75 move from the outer portions of the spiral elements, the volume of compression areas 75 is reduced, and refrigerant gas in compression areas 75 is compressed. Compressed refrigerant gas confined within compression areas 75 eventually moves through discharge hole 65 formed in end plate 61. Finally, the compressed refrigerant gas is discharged into an external refrigerant circuit (not shown) through discharge port 67.

In motor-driven compressor 10, because drive circuit 4 is provided on the right side surface of partition wall 104 in suction housing 100, heat generated by inverter 2 of drive circuit 4 is absorbed in low-temperature refrigerant gas through partition wall 104. Therefore, drive circuit 4 may be sufficiently cooled without using cooling devices. Moreover, because cooling fins are provided on the left side surface of partition wall 104, in other words, on the reverse side of drive circuit 4; heat radiation from drive circuit 4 may be increased. Moreover, because refrigerant gas introduced from suction port 8 impinges against fins 106, lubricating oil in the refrigerant gas may be separated from the refrigerant gas. As a result, lubricating oil may be provided sufficiently to each sliding portion and bearing member in motor-driven compressor 10, and the amount of lubricating oil in the refrigerant gas of motor-driven compressor 10 may be reduced compared to that of known motor-driven compressors.

Figure 2B:
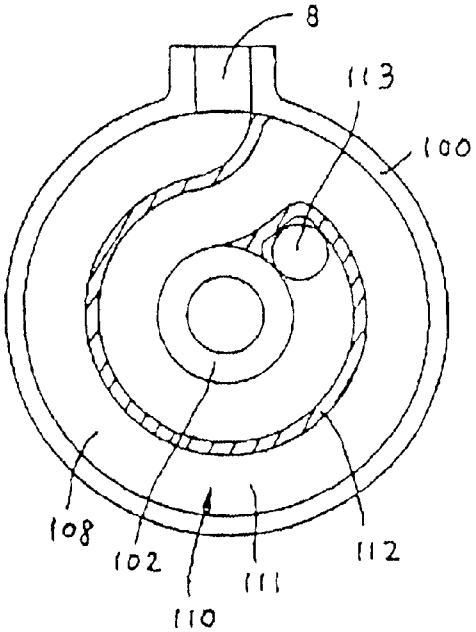
FIG. 2*b* is a cross-sectional view taken along the line 2B—2B of FIG. 2*a*.
Figure 2A:
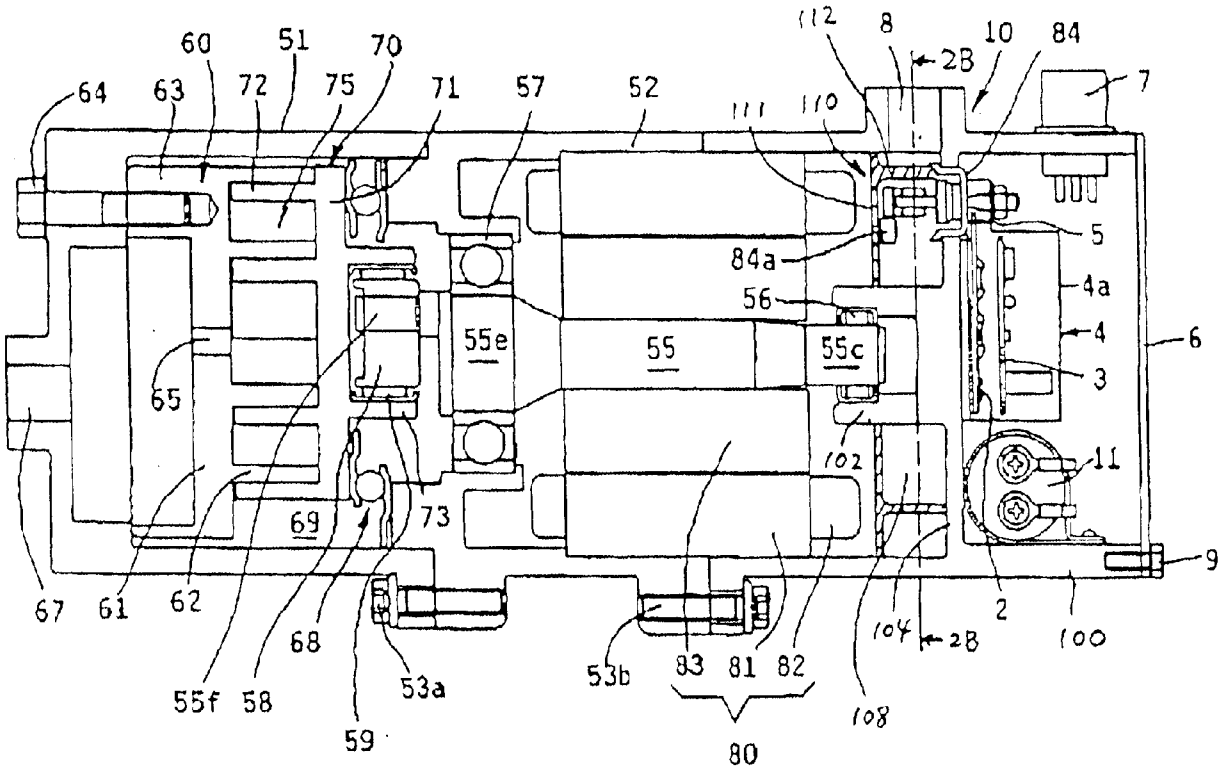
FIG. 2*a* is a longitudinal, cross-sectional view of a motor-driven compressor, according to a second embodiment of the present invention.

Referring to FIGS. 2*a* and 2*b*, a motor-driven compressor according to a second embodiment of the present invention is shown. In this embodiment, a lid member 100, which comprises an annular end wall 111 and a spiral wall 112 projecting from end wall 111, is inserted between an inner surface of a suction housing 100 and a projecting boss portion 102. An opening 113 is formed through about a center of end wall 111 and at about an end of spiral wall 112. A refrigerant flow path 108 is formed by lid member 110, a partition wall 104, and sealed terminals 84. Refrigerant flow path 108 is in contact with a reverse side surface from that on which drive circuit 4 is provided. The remaining structure of the motor-driven compressor according to the second embodiment is substantially the same as the structure of the motor-driven compressor according to the first embodiment, except that lid member 110 is used instead of cooling fins 106. In this embodiment of the present invention, refrigerant flow path 108 is formed on the left side of partition wall 104, in other words, on the reverse side surface from that on which drive circuit 4 is provided. Therefore, heat radiation from drive circuit 4 may be increased. Moreover, because refrigerant gas introduced from suction port 8 impinges against the spiral wall 112 constituting an enclosing wall of refrigerant flow path 108, lubricating oil in the refrigerant gas may be separated from the refrigerant gas. As a result, lubricating oil may be provided sufficiently to each sliding portion and bearing member in motor-driven compressor 10, and the amount of lubricating oil in the refrigerant gas of motor-driven compressor 10 may be reduced compared to that of known motor-driven compressors.

Figure 3B:
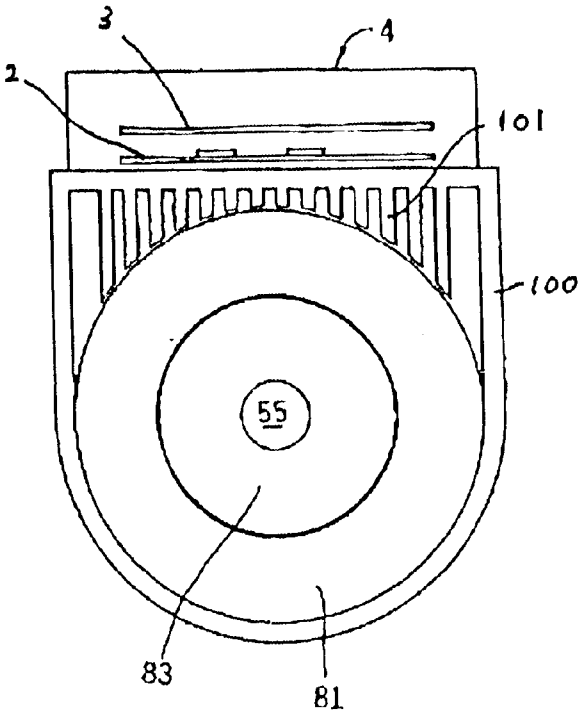
FIG. 3*b* is a cross-sectional view taken along the line 3B—3B of FIG. 3*a*.
Figure 3A:
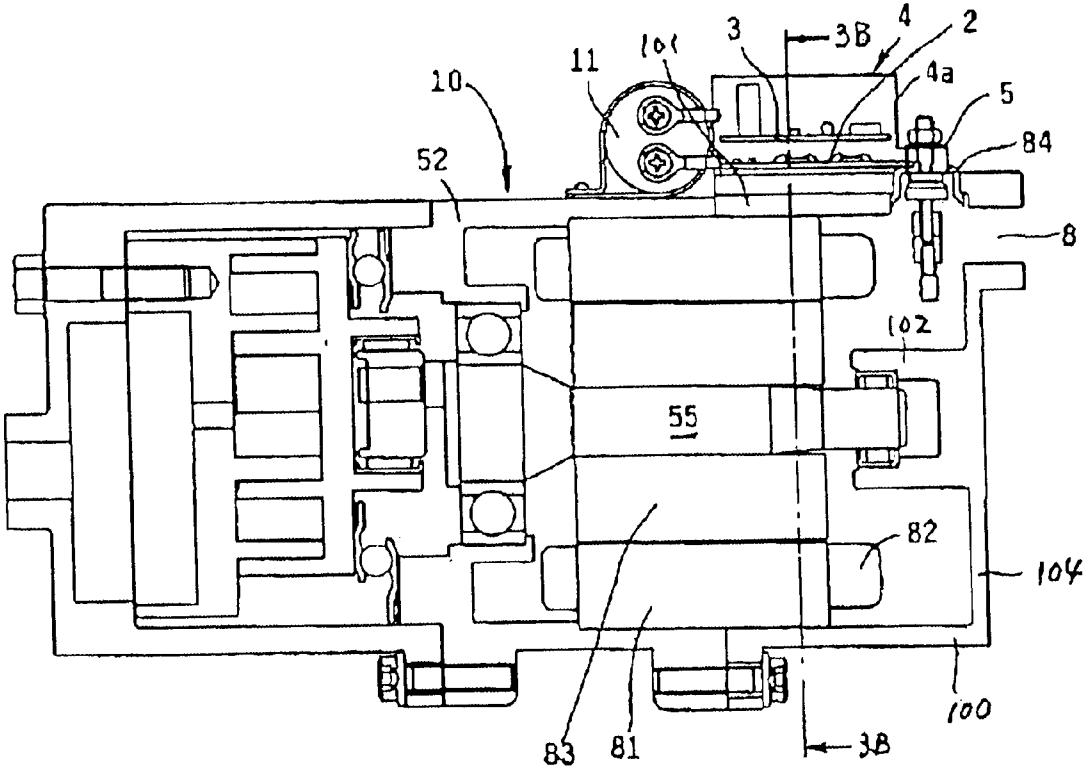
FIG. 3*a* is a longitudinal, cross-sectional view of a motor-driven compressor, according to a third embodiment of the present invention.

Referring to FIGS. 3*a* and 3*b*, a motor-driven compressor of a third embodiment of the present invention is shown. In this embodiment, a drive circuit 4 and sealed terminals 84 are provided on an outer peripheral surface of a suction housing 100. A capacitor 11 is provided on an outer peripheral surface of an intermediate housing 52. A partition wall 104 forms an end wall of suction housing 100. A suction port 8 is formed through partition wall 104. A plurality of cooling fins 101 are formed integrally with suction housing 100 and project from a reverse side surface from that on which drive circuit 4 is provided. The remaining structure of the motor-driven compressor according to the third embodiment is substantially the same as the structure of the motor-driven compressor according to the first embodiment, except as described above. In this embodiment of the present invention, because cooling fins 101 are formed on an inner surface of an attachment portion for drive circuit 4 on the outer peripheral portion of suction housing 100, in other words, an inner surface of an attachment portion of drive circuit 4 on an enclosing wall of a refrigerant suction passage. As a result, heat radiation from drive circuit 4 may be increased. Moreover, because refrigerant gas introduced from suction port 8 impinges against cooling fins 101, lubricating oil in the refrigerant gas may be separated from the refrigerant gas. As a result, lubricating oil may be provided sufficiently to each sliding portion and bearing member in motor-driven compressor 10, and the amount of lubricating oil in the refrigerant gas of motor-driven compressor 10 may be reduced compared to that of known motor-driven compressors.

Figure 4:
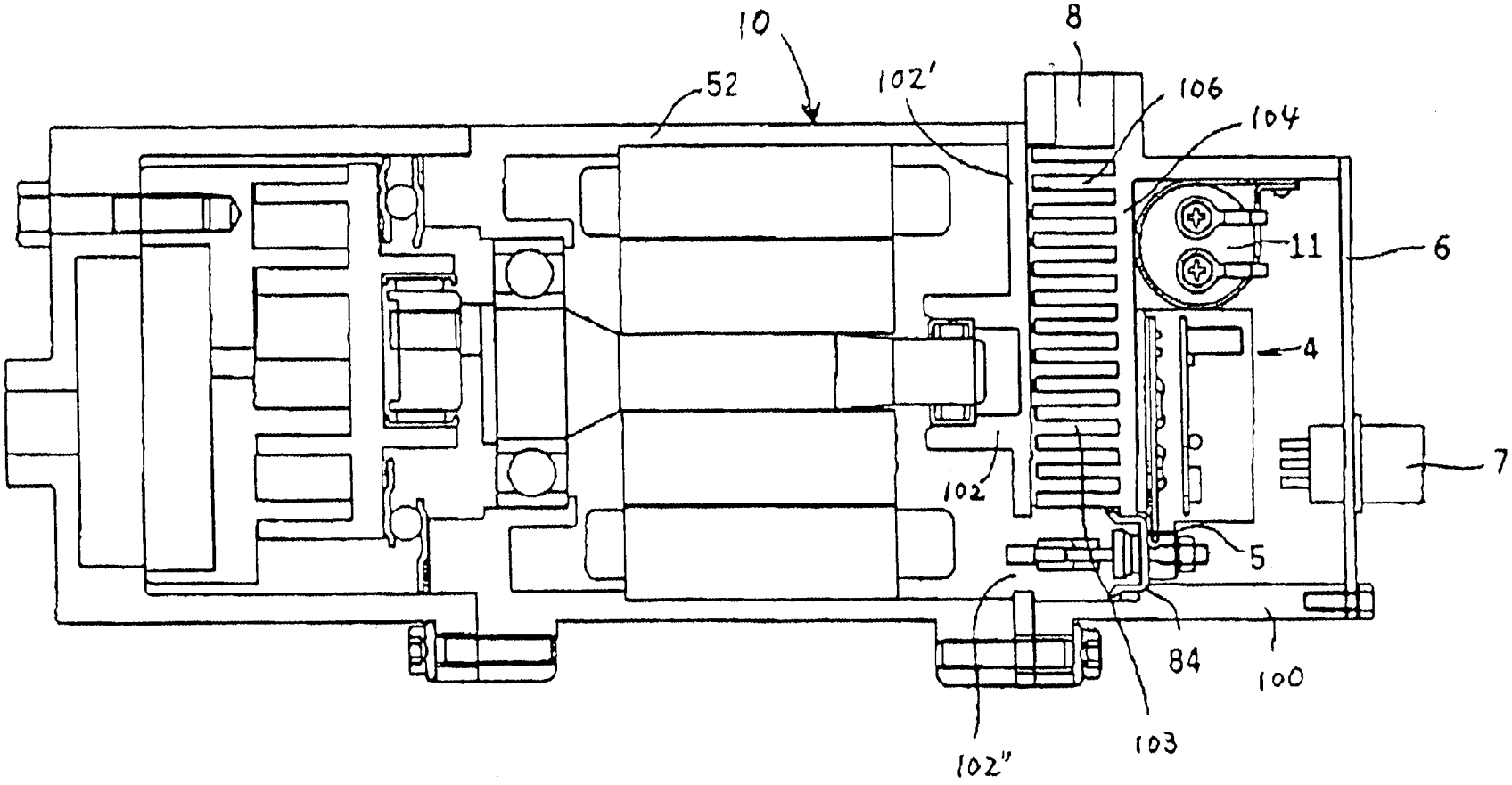
FIG. 4 is a longitudinal, cross-sectional view of a motor-driven compressor, according to a fourth embodiment of the present invention.

Referring to FIG. 4, a motor-driven compressor of a fourth embodiment of the present invention is shown. In this embodiment, a partition wall 104 and a projecting boss portion 102 is formed separately. A flange portion 102', which is formed integrally with projecting boss portion 102, covers a plurality of cooling fins 106. Cooling fins 106 are formed integrally with partition wall 104. An opening 102" is formed through flange portion 102'. A refrigerant flow path 103 is formed by flange portion 102' of boss portion 102, cooling fins 106 of partition wall 104, and sealed terminals 84. A suction port 8 communicates with opening 102" through refrigerant flow path 103. Refrigerant flow path 103 is in contact with a reverse side surface from that on which drive circuit 4 is provided. A connector 7 is provided on a lid 6. Sealed terminals 84 are disposed between an end of partition wall 104 and an inner surface of suction housing 100. The remaining structure of the motor-driven compressor according to the fourth embodiment is substantially the same as the structure of the motor-driven compressor according to the first embodiment, except as described above and with respect to the position of output terminals 5.

In this embodiment of the present invention, refrigerant flow path 103 is formed on the left side of partition wall 104, in other words, on the reverse side surface from that on which drive circuit 4 is provided. Therefore, heat radiation from drive circuit 4 may be increased. Moreover, because refrigerant gas introduced from suction port 8 impinges against the cooling fins 106, which constitute an enclosing wall of refrigerant flow path 103, lubricating oil in the refrigerant gas may be separated from the refrigerant gas. As a result, lubricating oil may be provided sufficiently to each sliding portion and bearing member in motor-driven compressor 10, and the amount of lubricating oil in the refrigerant gas of motor-driven compressor 10 may be reduced compared to that of known motor-driven compressors.

Figure 5B:
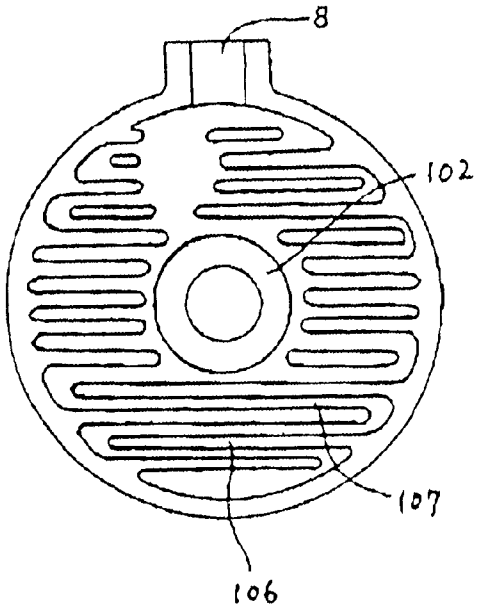
FIG. 5*b* is a cross-sectional view taken along the line 5B—5B of FIG. 5*a*.
Figure 5A:
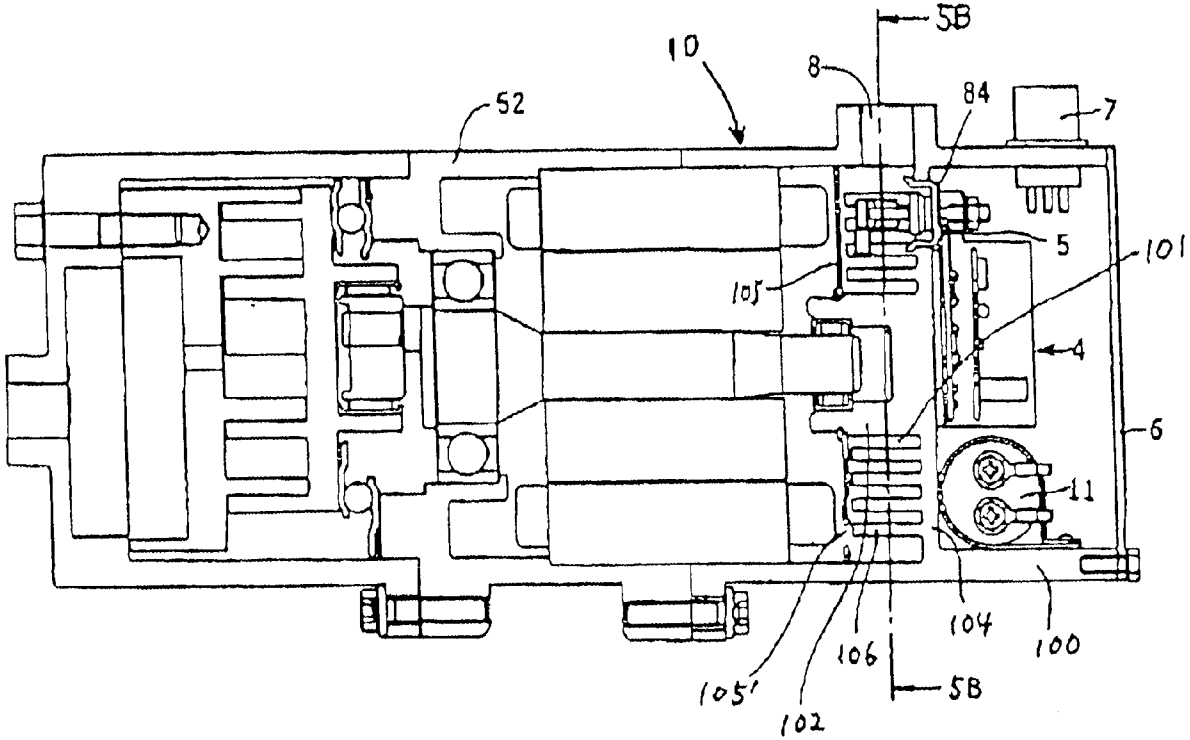
FIG. 5*a* is a longitudinal, cross-sectional view of a motor-driven compressor, according to a fifth embodiment of the present invention.

Referring to FIGS. 5*a* and 5*b*, a motor-driven compressor according to a fifth embodiment of the present invention is shown. In this embodiment, an annular plate 105 is inserted between an inner surface of a suction housing 100 and an outer surface of a projecting boss portion 102. Annular plate 105 covers a plurality of cooling fins 106, which are formed integrally with a partition wall 104. An opening 105' is formed through annular plate 105. A refrigerant flow path 107 is formed by a partition wall 104, scaled terminals 84, and cooling fins 106. A suction port 8 communicates with opening 105' through a refrigerant flow path 107. Refrigerant flow path 107 is in contact with a reverse side surface from that on which a drive circuit 4 is provided. The remaining structure of the motor-driven compressor according to the fifth embodiment is substantially the same as the structure of the motor-driven compressor according to the first embodiment, except as described above. In this embodiment of the present invention, refrigerant flow path 107 is formed on the left side of partition wall 104, in other words, on the reverse side surface from that on which drive circuit 4 is provided. Therefore, heat radiation from drive circuit 4 may be increased. Moreover, because refrigerant gas introduced from suction port 8 impinges against cooling fins 106, which constitute an enclosing wall of refrigerant flow path 107, lubricating oil in the refrigerant gas may be separated from the refrigerant gas. As a result, lubricating oil may be provided sufficiently to each sliding portion and bearing member in motor-driven compressor 10, and the amount of lubricating oil in the refrigerant gas of motor-driven compressor 10 may be reduced compared to that of known motor-driven compressors.

Figure 6B:
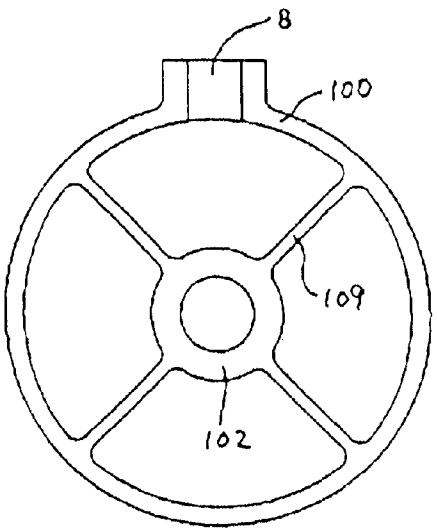
FIG. 6*b* is a cross-sectional view taken along the line 6B—6B of FIG. 6*a*.
Figure 6A:
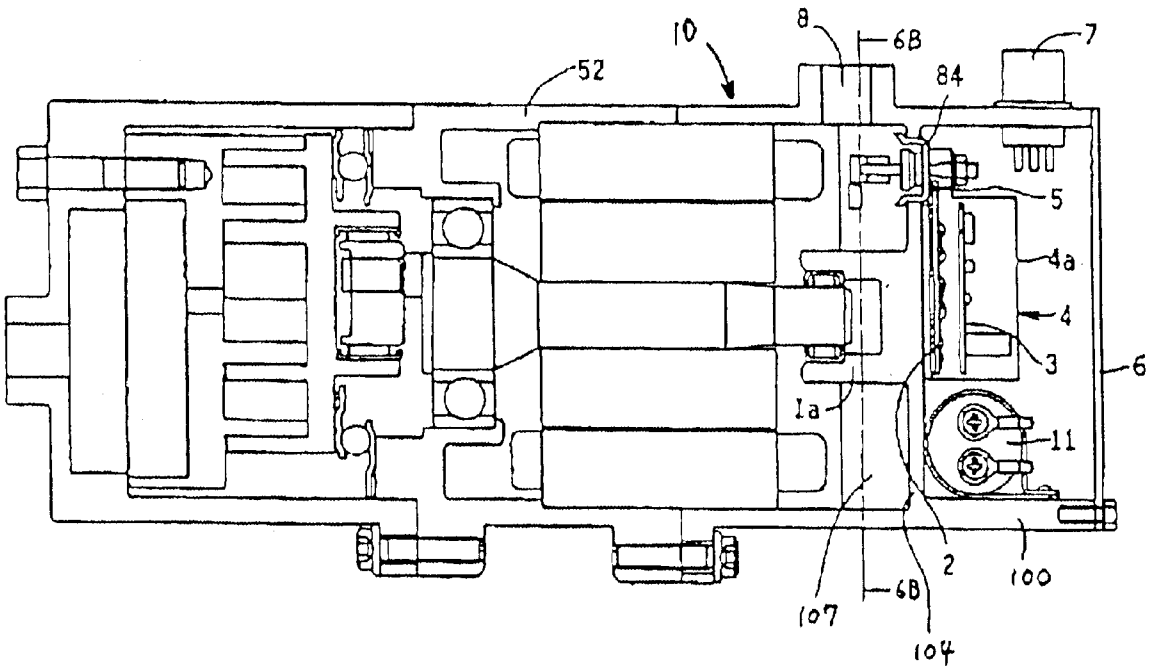
FIG. 6*a* is a longitudinal, cross-sectional view of a motor-driven compressor, according to a sixth embodiment of the present invention.

Referring to FIGS. 6*a* and 6*b*, a motor-driven compressor according to a sixth embodiment of the present invention is shown. In this embodiment, a plurality of ribs 109 for reinforcing a projecting boss portion 102 are formed integrally with a partition wall 104. Projecting boss portion 102 is coupled with a suction housing 100 via ribs 109. The remaining structure of the motor compressor according to the sixth embodiment is substantially the same as the structure of the motor-driven compressor according to the first embodiment, except that ribs 109 are provided instead of cooling fins 106. In this embodiment of the present invention, ribs 109 are in contact with the left side of partition wall 104, in other words, ribs 109 are on the reverse side surface from that on which drive circuit 4 is provided. Therefore, heat radiation from drive circuit 4 may be increased. Moreover, because refrigerant gas introduced from suction port 8 impinges against ribs 109, lubricating oil in the refrigerant gas may be separated from the refrigerant gas. As a result, lubricating oil may be provided to each sliding portion and bearing member in motor-driven compressor 10, and the amount of lubricating oil in the refrigerant gas of motor-driven compressor 10 may be reduced compared to that of known motor-driven compressors.

Figures 7A, 7B, 7C:
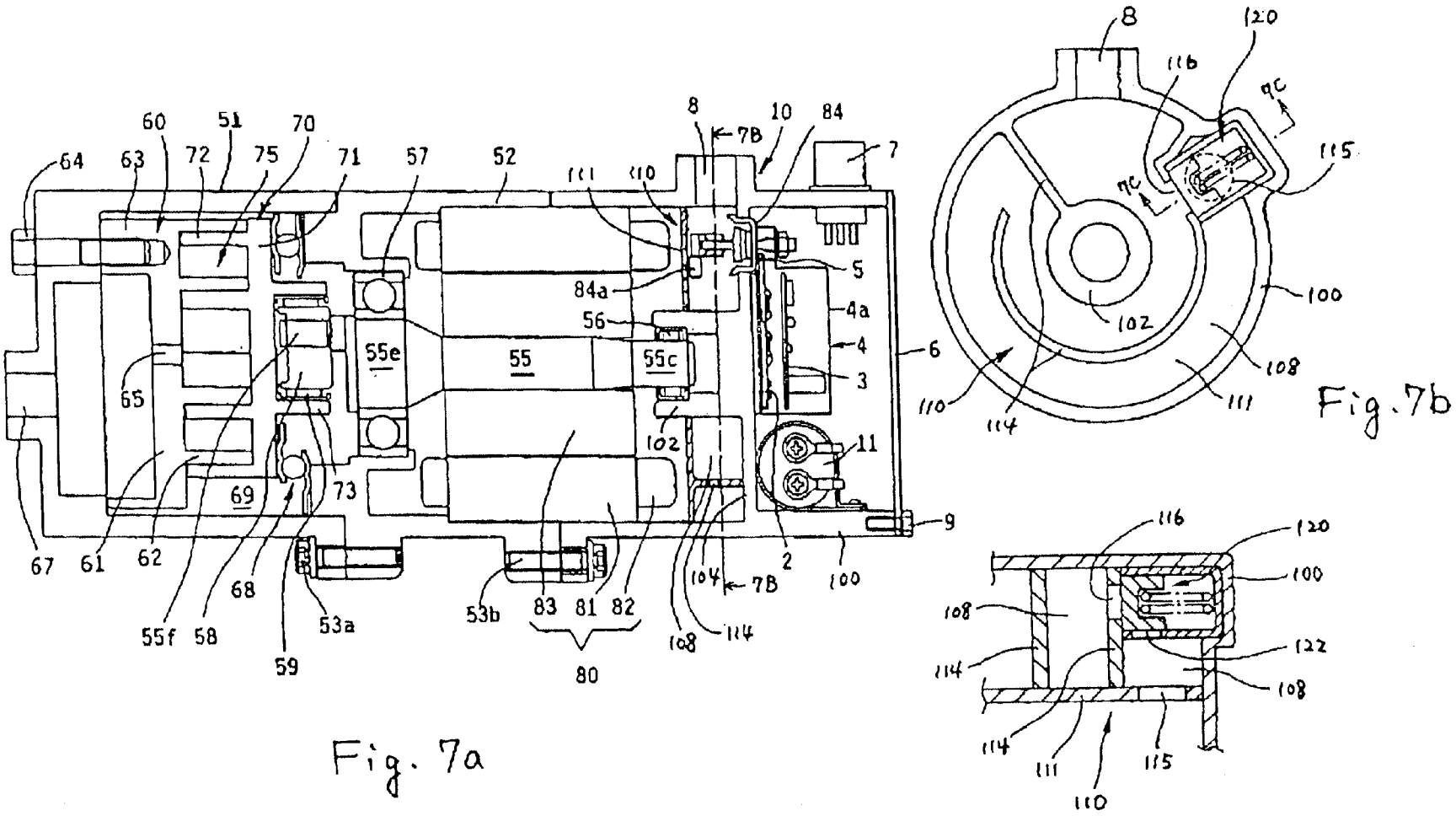
FIG. 7*a* is a longitudinal, cross-sectional view of a motor-driven compressor, according to a seventh embodiment of the present invention.
FIG. 7*b* is a cross-sectional view taken along the line 7B—7B of FIG. 7*a*.
FIG. 7*c* is a cross-sectional view taken along the line 7C—7C of FIG. 7*b*.

Referring to FIGS. 7*a*–7*c*, a motor-driven compressor according to a seventh embodiment of the present invention is shown. In this embodiment, a lid member 110 comprising an annular end wall 111 and a spiral wall 114 projected from end wall 111 is inserted between an inner surface of a suction housing 100 and an outer surface of a projecting boss portion 102. A first opening 115 is formed at a fringe portion of end wall 111 and adjacent to a suction port 8. A refrigerant flow path 108 is formed by lid member 110, partition wall 104, and sealed terminals 84. Refrigerant flow path 108 is in contact with the left side of partition wall 104, in other words, a reverse side surface on which drive circuit 4 is provided. Suction port 8 is an inlet of refrigerant flow path 108 and first opening 115 is an outlet of refrigerant flow path 108. A second opening 116 is formed through spiral wall 114 adjacent to suction port 8. A spring-driven valve member 120, which opens and closes second opening 116, is disposed in refrigerant flow path 108 adjacent to first opening 115. A third opening 122 is formed through a casing of valve member 120. When valve member 120 opens second opening 116, opening 122 communicates between second opening 116 and first opening 115. The remaining structure of the motor-driven compressor according to the seventh embodiment is substantially the same as the structure of the motor-driven compressor according to the first embodiment, except that lid member 110 is used, instead of cooling fins 106, and valve member 120 is provided.

In this embodiment of the present invention, refrigerant flow path 108 is formed on the left side of partition wall 104, in other words, on the reverse side surface from that on which drive circuit 4 is provided. Therefore, heat radiation from drive circuit 4 may be increased. Moreover, because refrigerant gas introduced from suction port 8 impinges against spiral wall 114 constituting an enclosing wall of refrigerant flow path 108, lubricating oil in the refrigerant gas may be separated from the refrigerant gas. As a result, lubricating oil may be provided sufficiently to each sliding portion and bearing member in motor-driven compressor 10, and the amount of lubricating oil in the refrigerant gas of motor-driven compressor 10 may be reduced compared to that of known motor-driven compressors. When motor-driven compressor 10 is operated at high speed, the amount of refrigerant gas may increase. As a result, a suction pressure of compression areas 75 may decrease due to pressure loss accompanied by refrigerant gas passing through refrigerant flow path 108, and a decrease of compression capacity of compression areas 75 may occur. In this embodiment of the present invention, however, when motor-driven compressor 10 is operated at high speed, and the amount of refrigerant gas is increased, valve member 120 opens second opening 116, and second opening 116 is communicated with first opening 115. Consequently, a portion of refrigerant gas passes from about the inlet of refrigerant flow path 108 to about the outlet of refrigerant flow path 108. As a result, pressure loss in motor-driven compressor 10 may be suppressed, and a decrease of compression capacity of compression areas 75 may be suppressed. Because the portion of refrigerant gas passes from about the inlet of refrigerant flow path 108 to about the outlet of refrigerant flow path 108, the amount of refrigerant gas flowing in refrigerant flow path 108 may be decreased. However, the amount of heat generated by inverter 2 may not increase during high-speed compressor operation compared to that during low-speed compressor operation. Therefore, inverter 2 may be cooled sufficiently by refrigerant gas flowing through refrigerant flow path 108 via partition wall 104.

Figure 8B:
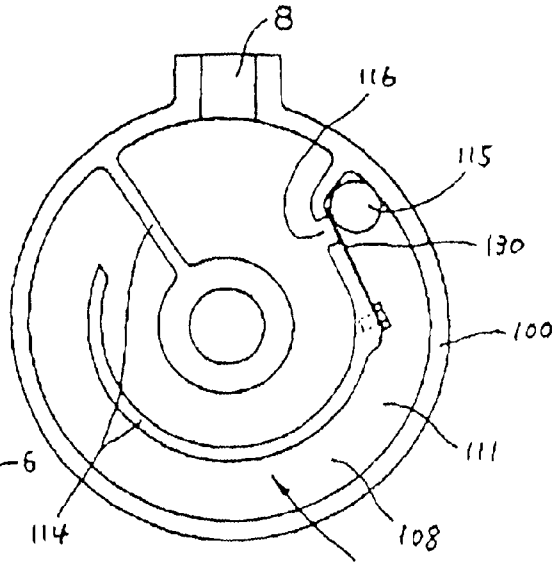
FIG. 8*b* is a cross-sectional view taken along the line 8B—8B of FIG. 8*a*.
Figure 8A:
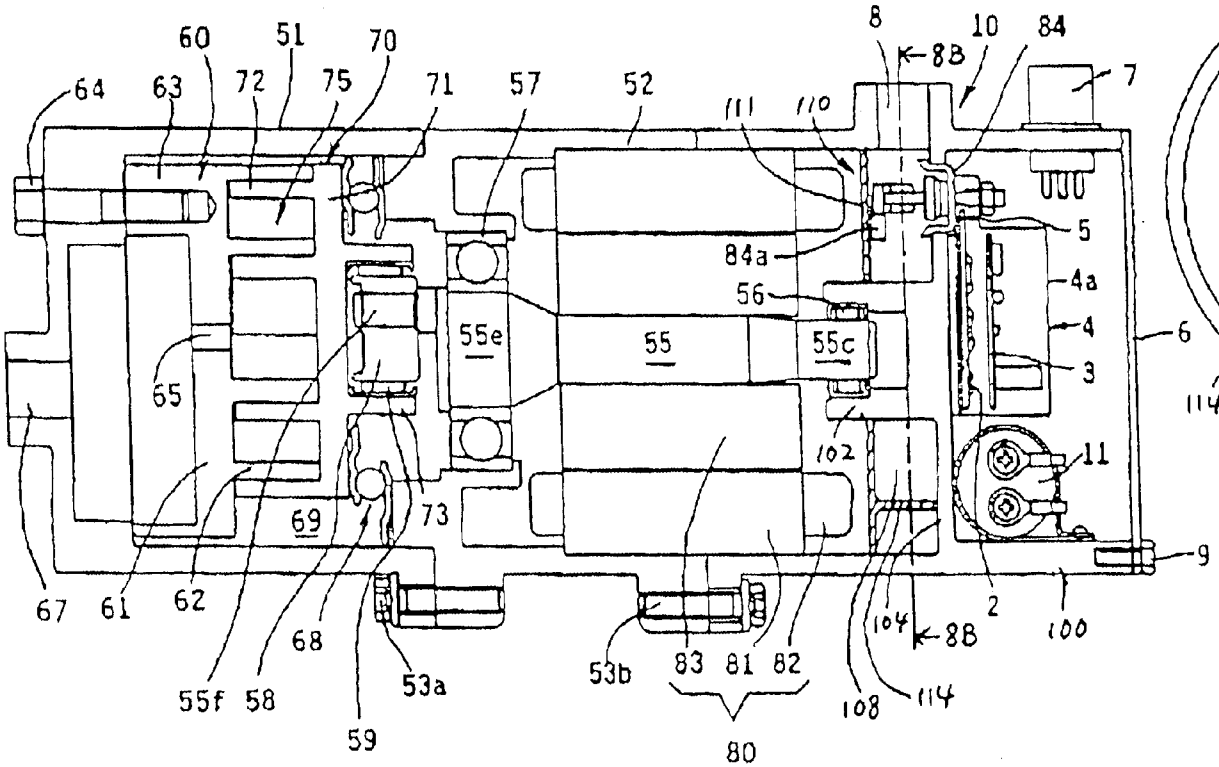
FIG. 8*a* is a longitudinal, cross-sectional view of a motor-driven compressor, according to an eighth embodiment of the present invention.

Referring to FIGS. 8*a* and 8*b*, a motor-driven compressor according to an eighth embodiment of the present invention is shown. In this embodiment, a reed valve 130, which opens and closes a second opening 116, is disposed on a spiral wall 114 adjacent to a first opening 105. The remaining structure of the motor-driven compressor according to the eighth embodiment is substantially the same as the structure of the motor-driven compressor according to the seventh embodiment, except that reed valve 130 is provided instead of spring-driven valve member 120. In this embodiment of the present invention, when motor-driven compressor 10 is operated at high speed and pressure loss of refrigerant gas is increased, reed valve 130 opens second opening 116. A portion of refrigerant gas passes from about the inlet of refrigerant flow path 108 to about the outlet of refrigerant flow path 108 because second opening 116 communicates with first opening 115. As a result, pressure loss in motor-driven compressor 10 may be suppressed, and a decrease of compression capacity of compression areas 75 may be suppressed.

Figure 9B:
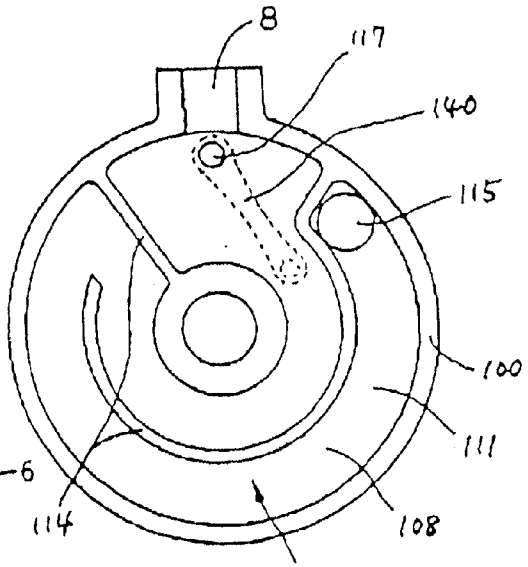
FIG. 9*b* is a cross-sectional view taken along the line 9B—9B of FIG. 9*a*.
Figure 9A:
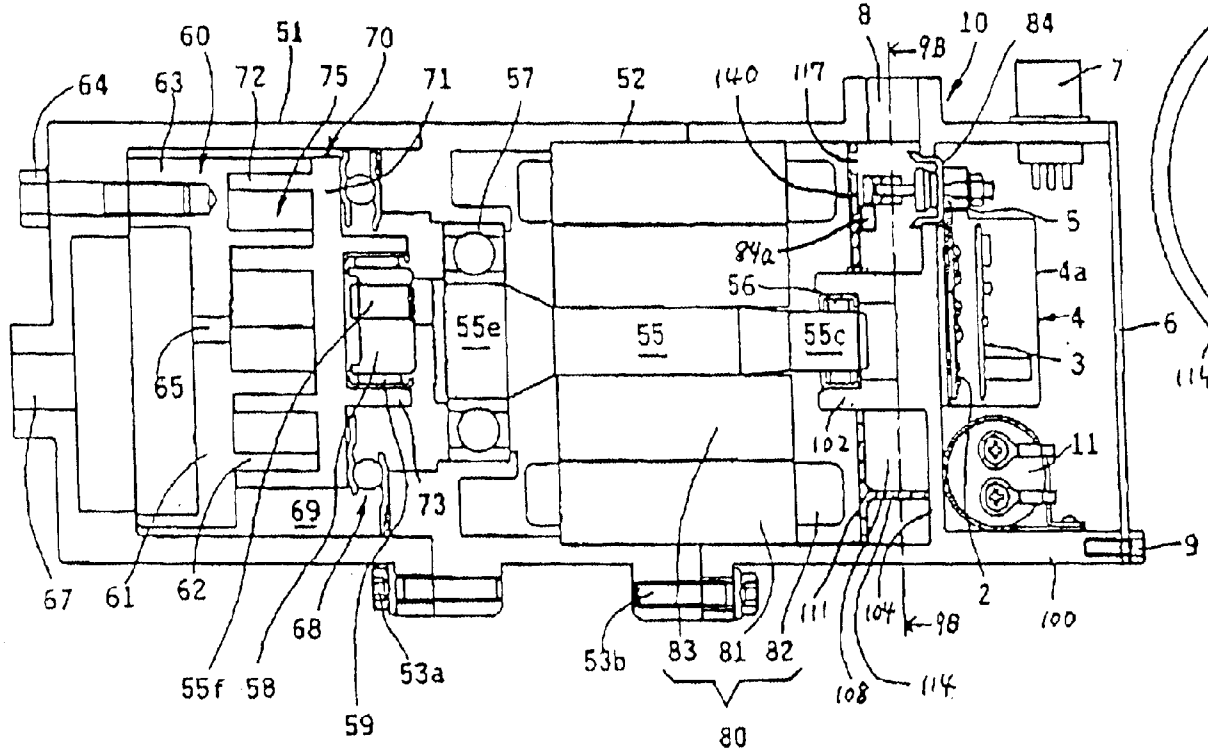
FIG. 9*a* is a longitudinal, cross-sectional view of a motor-driven compressor, according to a ninth embodiment of the present invention.

Referring to FIGS. 9*a* and 9*b*, a motor-driven compressor according to a ninth embodiment of the present invention is shown. In this embodiment, a third opening 117 is formed through an annular end wall 111 and adjacent to a suction port 8. A reed valve 140 opens and closes third opening 117. The remaining structure of the motor-driven compressor according to the ninth embodiment is substantially the same as the structure of the motor-driven compressor according to the seventh embodiment, except that third opening 117 is formed instead of second opening 116 and reed valve 140 is provided instead of spring-driven valve 120. In this embodiment of the present invention, when motor-driven compressor 10 is operated at high speed and pressure loss of refrigerant gas is increased, reed valve 140 opens third opening 117. A portion of refrigerant gas flows outside from about the inlet of refrigerant flow path 108 to third opening 117. As a result, pressure loss in motor-driven compressor 10 may be suppressed, and a decrease of compression capacity of compression areas 75 may be suppressed.

As described above, in a motor-driven compressor with respect to embodiments of the present invention, because a drive circuit is provided on the exterior side surface of an enclosing wall of a refrigerant flow path, heat generated by an inverter of the drive circuit is absorbed by low-temperature refrigerant gas through the enclosing wall of the refrigerant flow path. Therefore, in the embodiments of the present invention, providing cooling devices for the drive circuit in the motor-driven compressor is no longer necessary. Moreover, because a plurality of cooling fins are provided on the interior surface of the enclosed wall of the refrigerant flow path, heat radiation from the drive circuit may be increased. In addition, because refrigerant gas impinges against the cooling fins, lubricating oil in the refrigerant gas may be separated from the refrigerant gas. As a result, lubricating oil may be provided sufficiently to each sliding portion and bearing member in the motor-driven compressor, and the amount of lubricating oil in the refrigerant gas of the motor-driven compressor may be reduced compared to that of the known motor-driven compressors.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A motor-driven compressor formed integrally with a compressor device for compressing refrigerant and a motor, said motor-driven compressor comprising:

a drive circuit for controlling the operation of said motor, said drive circuit provided on an outer side of a wall of a refrigerant suction passage; and a plurality of cooling fins formed on an inner side of said wall of said refrigerant suction passage.

2. A motor-driven compressor formed integrally with a compressor device for compressing refrigerant and a motor, said motor-driven compressor comprising:

a drive circuit for controlling the operation of said motor, said drive circuit attached on an outer surface of a wall of a refrigerant suction passage; and a refrigerant flow path adjacent to an inner surface of said wall opposite the attachment between of said driving circuit and said inner surface of the wall.

3. The motor-driven compressor of claim 2, further comprising:

a bypass communicating between an inlet portion of said refrigerant flow path and an outlet portion of said refrigerant flow path; and a valve member opening and closing said bypass.

4. The motor-driven compressor of claim 2, wherein a first outlet port is formed at an end of said refrigerant flow path, and a second outlet port is formed at an inlet portion of said refrigerant flow path, and wherein a reed valve opening and closing said second outlet port is provided.

5. A motor-driven compressor formed integrally with a compressor device for compressing refrigerant and a motor, said motor-driven compressor comprising:

a drive circuit for the operation of said motor, said drive circuit provided on an outer surface of a wall of a refrigerant suction passage; and a plurality of ribs for reinforcing an annular boss, which supports one end of a drive shaft, provided on an inner surface of said wall of an attachment portion of said drive shaft.

* * * * *